US005308093A

United States Patent [19]

Walin

[11] Patent Number: 5,308,093

[45] Date of Patent: May 3, 1994

[54] SKATE BRAKE

[75] Inventor: Richard D. Walin, Brooklyn Park, Minn.

[73] Assignee: Creative Sports Concepts, Incorporated, Brooklyn Park, Minn.

[21] Appl. No.: 840,854

[22] Filed: Feb. 25, 1992

[51] Int. Cl.[5] ..... A63C 17/14

[52] U.S. Cl. ..... 280/11.2; 188/4 B

[58] Field of Search ..... 280/11.2, 11.22; 188/1.12, 4 B, 5, 23, 82.8, 82.84, 83

[56] References Cited

U.S. PATENT DOCUMENTS

| | | | |
|---|---|---|---|
| 334,739 | 1/1886 | Blum | 280/11.2 |
| 4,088,334 | 5/1978 | Johnson | 280/11.2 |
| 4,402,520 | 9/1983 | Ziegler | 280/11.2 |

*Primary Examiner*—David M. Mitchell
*Assistant Examiner*—Andrew C. Pike
*Attorney, Agent, or Firm*—Faegre & Benson

[57] ABSTRACT

A skate and skate brake which allows a user to brake the skate smoothly and evenly without catching on a ground surface utilizes a rotatable assembly having a resilient outer circumferential member attached to a relatively hard inner hub, the rotatable assembly brakes the skate by rotating with a rotational friction greater than that of the average rotational friction of the skate wheels. The rotational friction of the rotatable assembly is controlled by locating a non-rotating brake pad in physical contact with the inner hub. The amount of rotational friction can be increase by urging the brake pads against an annular portion of the inner hub and by positioning the brake pads within an interior recess inside the inner hub so that an increase in the downward force that the user applies to the brake increases the force by which the inner hub of the rotatable assembly is urged against the brake pads. A method for braking a skate includes the steps of pivoting the skate about a wheel, rotating a rotatable assembly in contact with a ground surface while applying friction to the rotation of the rotatable assembly by urging a non-rotating brake pad against a relatively hard interior surface of the rotating rotatable assembly.

31 Claims, 5 Drawing Sheets

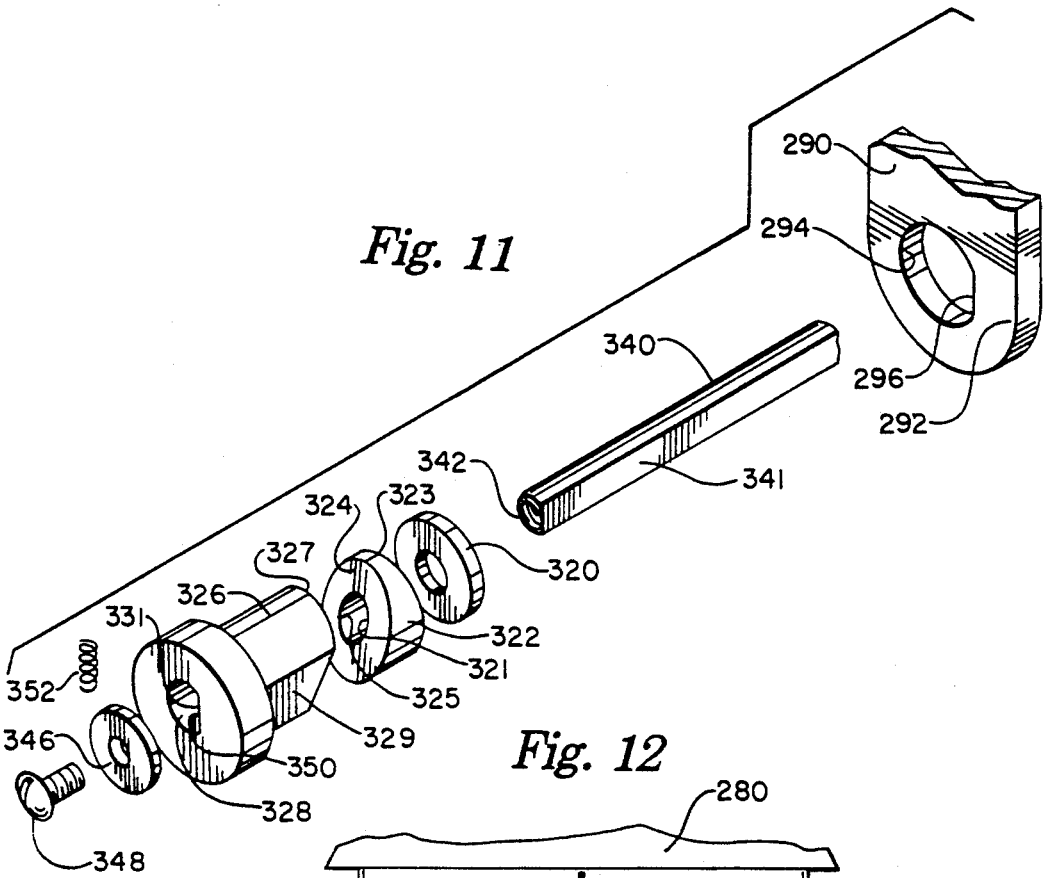
Fig. 11
Fig. 12
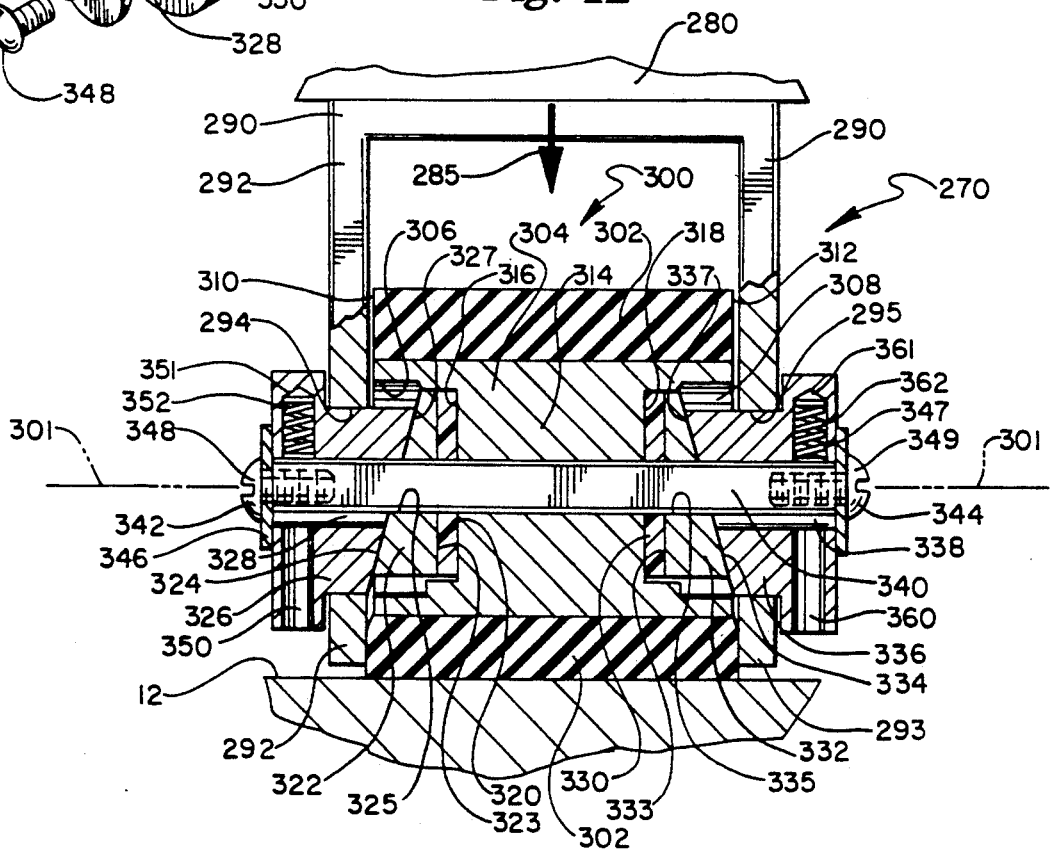

SKATE BRAKE

BACKGROUND OF THE INVENTION

This invention relates to a brake for in-line and traditional roller skates and skate boards (collectively referred to as skates) as well as a method for braking skates. Skates such as in-line roller skates are capable of carrying users at great speeds and therefore are desirably provided with a brake. Prior art skate brakes are typically simply a piece of resilient material held by a bracket that is attached to either the front or rear of the skate. When braking is desired, the user pivots a skate about its front or rear wheels and drags this material along the ground.

Unfortunately, when prior art brakes are dragged along the ground, they have a tendency to "catch" at specific points, causing the braking action to be jerky. This catching makes braking difficult for beginning skaters, since the sudden and uneven forces exerted can upset their balance and cause them to fall. This has an obvious effect on beginning skaters' enthusiasm for the sport. In addition, the jerkiness involved in using traditional brakes can make them difficult to use for even experienced users, since the higher speeds often obtained by experienced users demand even smoother braking to avoid an accident.

SUMMARY OF THE INVENTION

The present invention overcomes this disadvantage of the prior art by providing a brake having a rotatable assembly that rotates when in contact with the ground, thereby eliminating catching, while permitting braking to be applied smoothly and evenly, even at high speeds. The smooth action of the present brake provides for more stability during braking and for easier use among novice users of the skate. The amount of braking provided by this new brake design is determined by the rotational friction of the rotatable assembly, and can be adjusted or controlled in one of two ways: either in use by altering the downward force the user places on the brake, or in advance of use by mechanically preadjusting the brake. The present invention may be mounted on the rear of the skate, as is conventional on in-line roller skate designs, or on the front of the skate, as is conventional in traditional roller skates.

BRIEF DESCRIPTION OF THE DRAWINGS

FIG. 11 is a fragmentary detail perspective exploded view of selected elements shown in FIG. 10.

FIG. 12 is a view of the embodiment of FIG. 10 with the brake engaged.

DETAILED DESCRIPTION OF THE INVENTION

Figure 1:
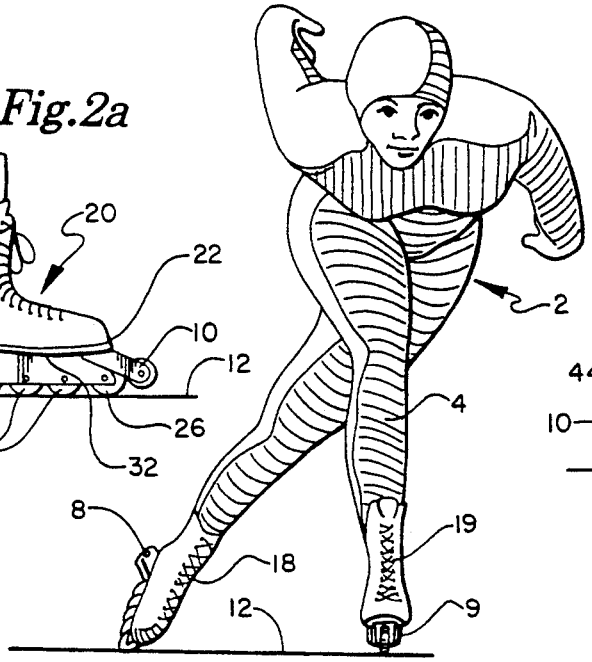
FIG. 1 is a perspective view of the present invention on in-line skates being used by a roller skater.

Referring to FIG. 1, a skater 2 is shown wearing two in-line roller skates 18, 19, each having a skate brake 8, 9, respectively, of the present invention attached. It is to be understood that the right leg 4 of the skater 2 is positioned so as to allow the skate 19 to glide without bringing the skate brake 9 into contact with the ground surface 12. The skate brake 9 on skate 19 is partially obscured in this view.

Figure 2A:
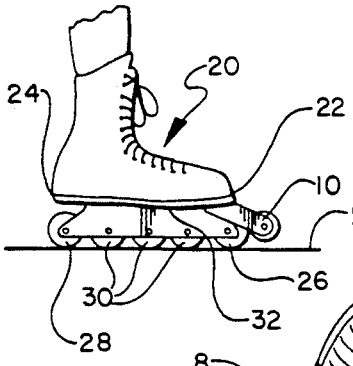
FIG. 2*a* is a fragmentary side elevational view thereof showing the invention attached to the front of an in-line skate during coasting.
Figure 2B:
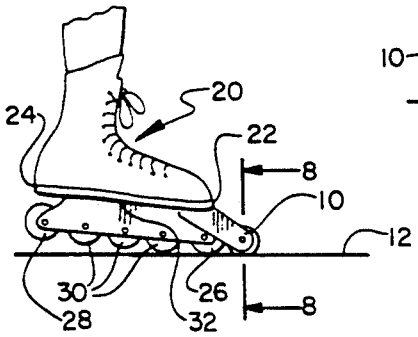
FIG. 2*b* is a fragmentary side elevational view thereof showing the invention attached to the front of an in-line skate during braking.

Referring now to FIG. 2*a*, in an alternative embodiment, a skate brake 10 can be seen mounted on a front end 22 of an in-line roller skate 20 resting on the ground surface 12. A front wheel 26, a rear wheel 28 and one or more additional wheels 30 are mounted on a bottom surface 32 of the in-line skate 20. The skate brake 10 is positioned so as to be above the ground surface 12 when the skate 20 is resting on two or more of the wheels 26, 28, 30. When braking is desired, the in-line skate 20, which is preferably trailing the other in-line skate (not-shown) worn by the skater, is pivoted about the front wheel 26 so as to bring the skate brake 10 into contact with the ground surface 12. The skate 20 is shown while braking in FIG. 2*b*.

Figure 3:
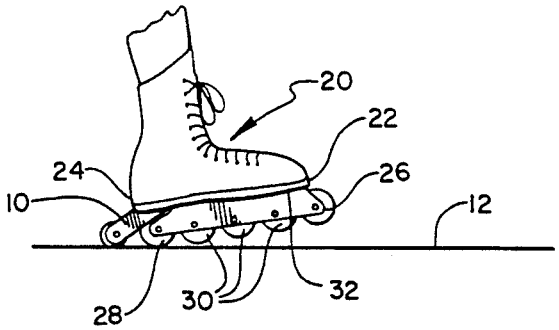
FIG. 3 is a fragmentary side elevational view thereof showing the invention attached to the rear of an in-line skate during braking.

Alternatively, the skate brake 10 may be mounted on a rear end 24 of the in-line skate 20, as shown in FIG. 3. If the skate brake 10 is mounted on the rear end 24, the in-line skate 20 is pivoted about the rear wheel 28 to bring the skate brake 10 into contact with the ground surface 12 when braking is desired.

Figure 4A:
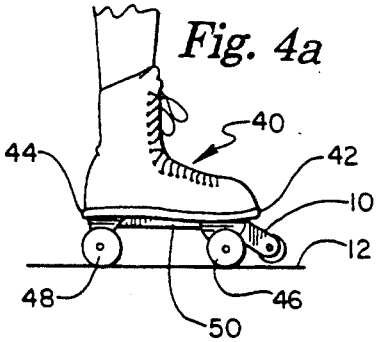
FIG. 4*a* is a fragmentary side elevational view thereof showing the invention attached to the front of a traditional skate during coasting.
Figure 4B:
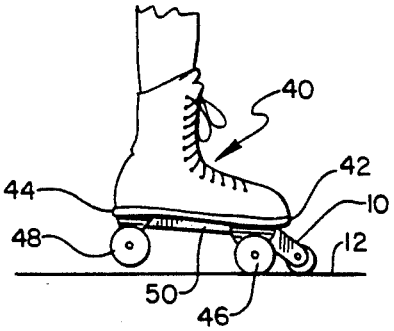
FIG. 4*b* is a fragmentary side elevational view thereof showing the invention attached to the front of a traditional skate during braking.

Referring now to FIG. 4*a*, a skate brake 10 of the present invention can be seen mounted on a front end 42 of a traditional style roller skate 40 resting on a ground surface 12. A pair of front wheels 46 and a pair of rear wheels 48 are mounted on a bottom surface 50 of the traditional skate 40. The skate brake 10 is positioned so as to be above the ground surface 12 when the skate 40 is resting on at least one of the front wheels 46 and one of the rear wheels 48. When braking is desired, the skate 40 is preferably pivoted about both front wheels 46 so as to bring the skate brake 10 into contact with the ground surface 12, as is shown in FIG. 4*b*.

Figure 5:
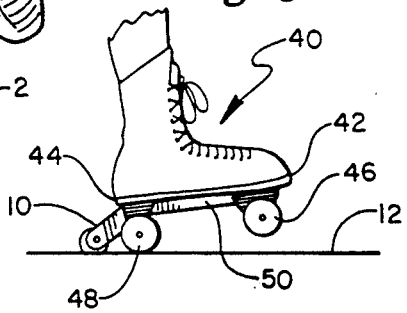
FIG. 5 is a fragmentary side elevational view thereof showing the invention attached to the rear of a traditional skate during braking.

Referring now to FIG. 5, in a still further alternative embodiment, the skate brake 10 is seen mounted on a rear end 44 of skate 40. When the skate brake 10 is mounted on the rear end 44, the traditional skate 40 is preferably pivoted about both rear wheels 48 to bring the skate brake 10 into contact with the ground surface 12 for braking.

Figure 6:
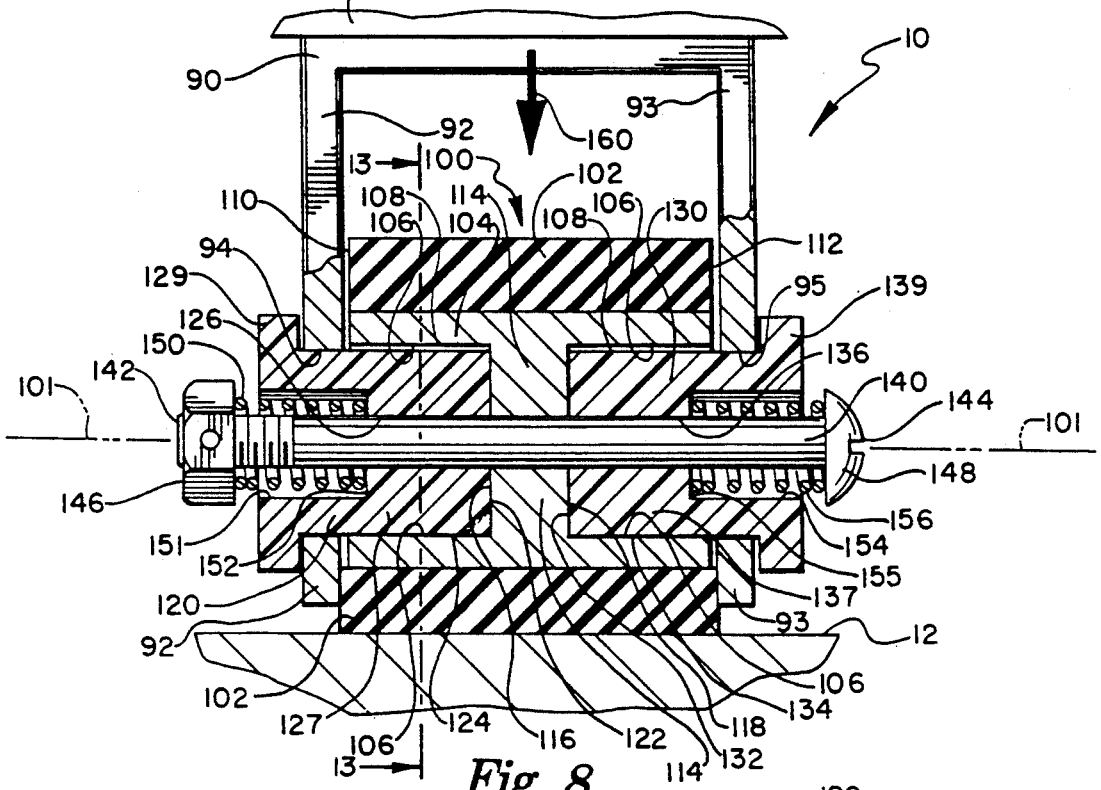
FIG. 6 is a section view of the invention taken along line 6—6 of FIG. 2*b*.
Figure 7:
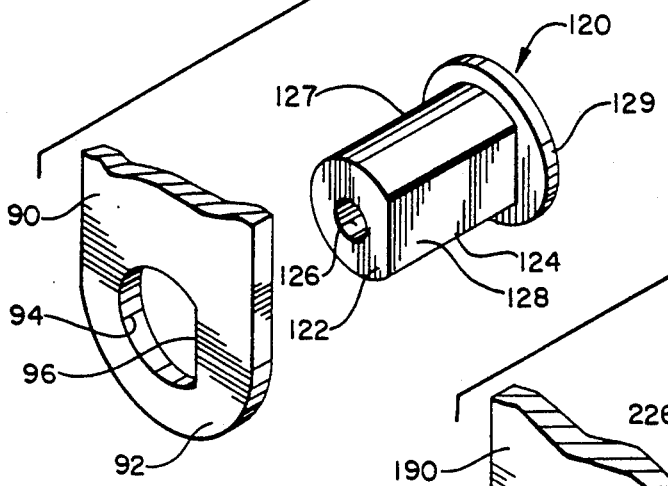
FIG. 7 is a reverse angle fragmentary detail perspective exploded view of selected elements shown in FIG. 6.

Referring now to FIGS. 6 and 7, the skate brake 10 of the present invention may be seen in more detail. The skate brake 10 is mounted to a skate 80 through a bracket 90, the bracket 90 having a first wing 92 and a second wing 93, each having portions defining holes 94, 95, respectively. The hole 94 is preferably a D-shaped aperture with a flat side 96. The hole 95 similarly has a flat side, which is not shown in the figures.

Located between the wings 92 and 93 is a rotatable assembly 100 designed to rotate about an axis of rotation 101. The rotatable assembly 100 has a first axial end 110, a second axial end 112, and an outer circumferential member 102, which has a generally circular cross-section and is preferably bonded to an inner hub 104. The outer circumferential member 102 is the only portion of the skate brake 10 which comes in contact with the ground surface 12 during braking and is preferably made of a moderately soft, resilient material such as urethane rubber. The inner hub 104 has an interior surface 106 which forms a recess 108. The interior surface 106 and the resulting recess 108 preferably have a cylindrical shape, but it is to be understood that other shapes are within the scope of this invention. An annular portion 114 extends radially inward from the interior surface 106 toward the axis of rotation 101 and is located intermediate the axial ends 110, 112. The annular portion 114 has a first side 116 which faces toward the first axial end 110 and a second side 118 which faces toward the second axial end 112. The annular portion 114 may be manufactured as a part of the inner hub 104, as shown, or may be fixedly attached to the interior surface 106 of the inner hub 104.

Located partially within the recess 108 is a first brake pad 120 and a second brake pad 130. The first brake pad 120 has a hub portion 127 with an end surface 122, a lateral surface 124, a flat side 128 and a flange 129. The end surface 122 is located adjacent to and in contact with the first side 116 of annular portion 114 while the lateral surface 124 is located adjacent to the interior surface 106 of the inner hub 104. The hub portion 127 of brake pad 20 extends through the hole 94 of the bracket 90. The flat surface 128 engages with the flat side 96 of the hole 94, thereby preventing the brake pad 120 from rotating with respect to the bracket 90.

Likewise, the second brake pad 130 has a hub portion 137 with an end surface 132, a lateral surface 134, a flat surface (not shown) and a flange 139. The end surface 132 is located adjacent to and in contact with the second side 118 of annular portion 114 while the lateral surface 134 is located adjacent to the interior surface 106 of the inner hub 104. The hub portion 137 extends through the hole 95 of the bracket 90 with the flat surface of the hub portion 137 engaged with the flat side of the hole 95, thereby preventing the brake pad 130 from rotating with respect to the bracket 90.

Figure 14:
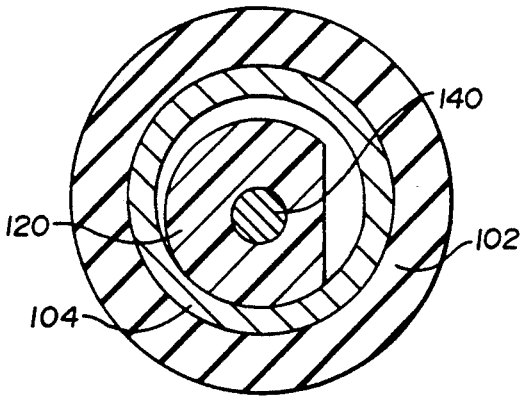
FIG. 14 is the same section view of the invention shown in FIG. 13 after there has been significant wearing of the invention.

The lateral surfaces 124, 134 of the brake pads 120, 130 are designed to drag against the interior surface 106 of the inner hub 104. Since the interior surface 106 preferably has a cylindrical shape, the lateral surfaces 124, 134 ideally have a partially cylindrical shape with a diameter which is slightly smaller than the diameter of the interior surface 106 as shown in FIG. 1. The slightly smaller diameter will allow the lateral surfaces 124, 134 to wear into a shape which more closely matches that of the interior surface 106 of the inner hub-portion 104, allowing a greater area of interaction as shown in FIG. 14. Thus, the braking power of the brake will increase with use. Note that even though in the present embodiment both the first lateral surface 124 and the second lateral surface 134 are adjacent to portions of the interior surface 106 that have identical diameters, it is to be understood to be within the scope of this invention to construct the inner hub 104 so that the interior surface 106 adjacent the first lateral surface 124 is of a different diameter than the portion of the interior surface 106 adjacent the second lateral surface 134.

Each of the brake pads 120, 130 also has a bore 126, 136, respectively, therethrough. An axle 140 preferably extends from beyond the first wing 92 of the bracket 90 through the hole 94, the recess 108, the bores 126, 136, the hole 95 and to beyond the second wing 93 of the bracket 90. The axle 140 has a first end 142 having a terminating member 146 and a second end 144 having a terminating member 148. In the present embodiment of this invention, the axle 140 comprises a partially threaded bolt, the terminating member 146 is a locking nut while the terminating member 148 is a button head of the bolt.

Located adjacent the terminating member 146 is a first compression means 150 which serves to push the end surface 122 of the first brake pad 120 against the first side 116 of the annular portion 114. The compression means 150 surrounds the axle 140 and extends from the terminating member 146 through a well or recess 151 of the brake pad 120 to a spring bearing surface 152 of the brake pad 120. Similarly, a second compression means 156 extends from the terminating member 148 through a well or recess 154 of the second brake pad 130 to a spring bearing surface 155 of the brake pad 130. The second compression means 156 serves to push the end surface 132 of the second brake pad 130 against the second side 118 of the annular portion 114. Although the drawings represent the compression means 150, 156 as two compression springs, a single spring or a different compression means altogether, such as Belleville washers, could be used and are also to be understood to be within the scope of the present invention.

The compression means 150, 156 and the bracket 90 hold the brake pads 120, 130 in place. The brake pads 120, 130 in turn hold the rotatable assembly 100 between the wings 92 and 93 of the bracket 90. In spite of its contact with the brake pads 120, 130, the rotatable assembly 100 is able to rotate about the axis of rotation 101, and is free to move a slight distance with respect to the brake pads 120, 130 perpendicular to the axis of rotation 101.

The rotatable assembly 100 and the brake pads 120, 130 are also free to move a slight distance with respect to the bracket 90 along the axis of rotation 101. To prevent the rotatable assembly 100 from rubbing against the bracket 90 as a result of this movement, the flanges 129, 139 of the brake pads 120, 130, respectively, are designed to abut the bracket 90 before the rotatable assembly 100 can make contact with the bracket 90. In addition, it is possible to add wave washers (not shown) between the sides 110, 112 of the rotatable assembly 100 and the bracket 90. While the wave washers encourage the rotatable assembly 100 to remain centered between the wings 92, 93 of bracket 90 when the brake 10 is not in use, the wave washers are not powerful enough to prevent the rotatable assembly from rotating around axis of rotation 101 or to prevent movement along the axis of rotation 101 during use. The primary purpose of the wave washers is to prevent the rotatable member 100 from rattling when not in use. Thus, even when the wave washers are utilized, it is important that the flanges 129, 139 be properly positioned to prevent the rotating assembly 100 from rubbing against the bracket 90.

Because of the drag which takes place between the brake pads 120, 130 and the annular portion 114 as well as between the brake pads 120, 130 and the interior surface 106 of inner hub 104, it is important that these parts be constructed of materials which can withstand the pressure and heat generated. In the present embodiment, these parts are manufactured from Balelite ®[1] (or other appropriate thermoset plastic) and aluminum. It is possible to make the brake pads 120, 130 of the thermoset plastic (Bakelite) and the annular portion 114 and the inner hub 104 from aluminum. However, it is preferable to make the brake pads 120, 130 of aluminum and the annular portion 114 and the inner hub 104 from the thermoset plastic (Bakelite). This second configuration allows the heat generated to escape through the brake pads 120, 130, rather than building up in the inner hub 104 where it might weaken the bond with the outer circumferential member 102. [1] Bakelite is a registered trademark of Union Carbide Corporation for synthetic plastics.

When a downward force 160 exerted by the skater 2 brings the skate brake 10 into contact with the ground surface 12 while in motion, the outer circumferential member 102 of the rotatable assembly 100 rolls along the ground surface 12 about the axis of rotation 101. Since the inner hub 104 and the annular portion 114 are fixedly attached to the outer circumferential member 102, these parts also rotate. This rotation will slow the skate which is attached to the skate brake 10, the extent of the braking being determined by the rotational friction of the rotatable assembly 100. This rotational friction is preferably significantly greater than the rotational friction of the wheels of the skate in order to provide substantial braking effect.

The rotational friction of the rotatable assembly 100 is increased in part by the drag or rubbing which takes place between the first and second sides 116, 118 of the annular portion 114 and the end surfaces 122, 132 of the brake pads 120, 130. The amount of friction provided at these locations can be varied by altering the degree to which the end surfaces 122, 132 are urged against the first and second sides 116, 118 of the annular portion 114. This is accomplished by altering the Compression of the compression means 150, 156 by either replacing the compression means 150, 156 with springs having a different stiffness, or by altering the distance between the brake pads 120, 130 and the terminating members 146, 148, respectively.

The rotational friction of the rotatable assembly 100 is also increased by the drag between the interior surface 106 of the inner hub 104 and the lateral surfaces 124, 134 of the first and second brake pad 120, 130, respectively. The amount of drag between the lateral surfaces 124, 134 and the interior surface 106 is altered by changing the amount of upward force which urges the interior surface 106 against the lateral surfaces 124, 134. Since this upward force is equal and opposite to the downward force 160, the upward force may be changed simply by changing the amount of downward force 160 which a skater (not shown) places on the skate brake 10.

A third braking force is found in tee contact between the outer circumferential member 102 and the ground surface 12. Since the outer circumferential member 102 is preferably formed of a moderately soft, resilient material, the outer circumferential member 102 will deform and reform when it makes and breaks contact with the ground surface 12. This deformation and reformation dissipates energy, and thereby contributes to the braking power of the skate brake. In order for this deformation to have a significant effect on the braking of the skate, the outer circumferential member 102 is preferably substantially softer than that of the circumference of the wheels of the skate (not shown).

Figure 8:
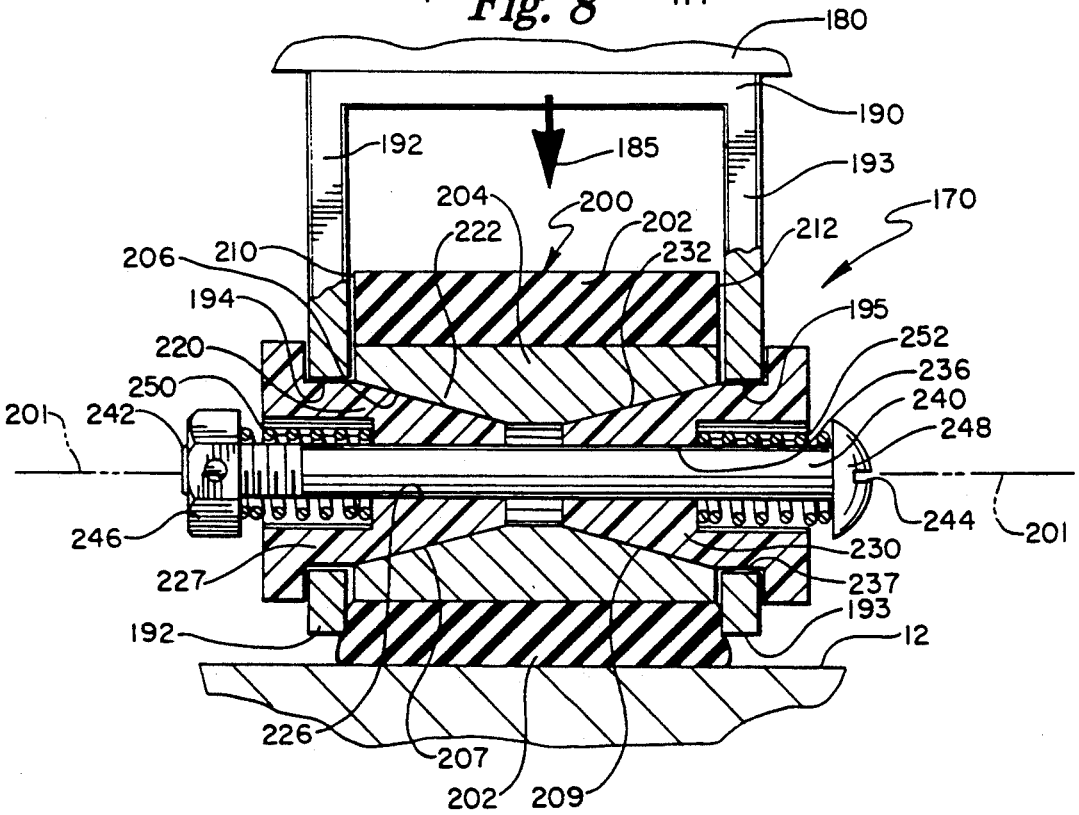
FIG. 8 is a section view of an alternative embodiment of the invention taken along the same plane as that of FIG. 6.
Figure 9:
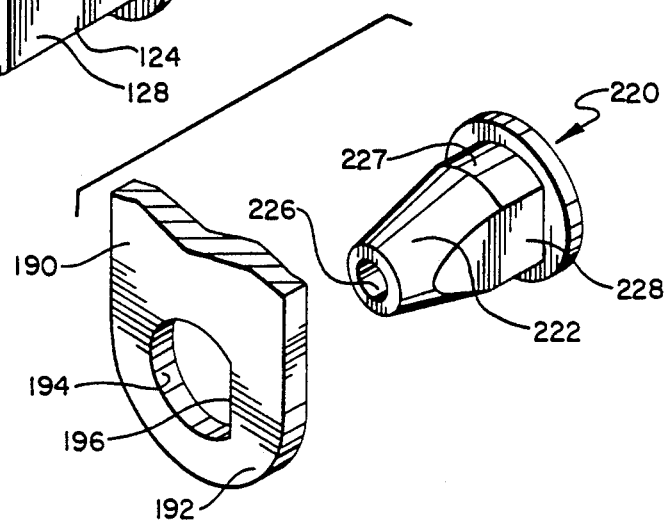
FIG. 9 is a reverse angle fragmentary detail perspective exploded view of selected elements shown in FIG. 8.

Referring now to FIGS. 8 and 9, another embodiment of the present invention can be seen. In this embodiment, a skate brake 170 is mounted to a skate 180 through a bracket 190, the bracket 190 having a first wing 192 and a second wing 193, each having portions defining holes 194, 195, respectively. As is true in the above-described first embodiment, the hole 194 is preferably a D-shaped aperture with a flat side 196, while the hole 195 similarly has a flat side which is not shown in the figures.

A rotatable assembly 200 is located between the wings 192 and 193. The rotatable assembly 200 is designed to rotate about an axis of rotation 201 and has a first axial end 210 and a second axial end 212. As above, the rotatable assembly 200 has an outer circumferential member 202 having a generally circular cross section, preferably bonded to an inner hub 204. The outer circumferential member 202 is the only portion of the skate brake 170 to make contact with the ground surface 12 during braking, and is preferably made of a moderately soft resilient material such as urethane rubber. The inner hub 204 has an interior surface 206 of a generally hourglass shape, forming a first tapered recess 207 and a second tapered recess 209.

Located partially within the first tapered recess 207 is a first brake pad 220 having a generally cone-shaped surface 222, a bore 226, a hub portion 227 and a flat side 228. The cone-shaped surface 222 is located adjacent to and in contact with the portion of the interior surface 206 which forms the first tapered recess 207. The hub portion 227 of the first brake pad 220 extends through the hole 194 of the bracket 190. The flat surface 228 engages with the flat side 196 of the hole 194, thereby preventing the brake pad 220 from rotating with respect to the bracket 190.

Located partially within the second tapered recess 209 is a second brake pad 230 having a generally cone-shaped surface 232, a bore 236, a hub portion 237 and a flat side (not shown). The cone-shaped surface 232 of the second brake pad 230 is located adjacent to and in contact with the portion of the interior surface 206 which forms the second tapered recess 209. The hub portion 237 extends through the hole 195 of the wing 193 of the bracket 190, with the flat surface of the second brake pad 230 engaged with the flat side of the hole 195, thereby preventing the brake pad 230 from rotating with respect to the bracket 190.

An axle 240 extends from beyond the first wing 192 of the bracket 190 through the hole 194, the first tapered recess 207, the bores 226, 236, the second tapered recess 209 and to beyond the second wing 193 of the bracket 190. As in the first embodiment, the axle 240 has a first end 242 with a terminating member 246 and a second end 244 having a terminating member 248. Located adjacent the terminating members 246, 248 are a first and second compression means 250, 252, respectively, which urge the cone-shaped surfaces 222, 232 of the brake pads 220, 230 against the interior surface 206. The compression means 250, 252 work in an identical fashion to the compression means of the first embodiment, and will not be further discussed.

When a downward force 185 exerted by a skater (not shown) brings the skate brake 170 into contact with the ground surface 12 while in motion, the outer circumferential member 202 of the rotatable assembly 200 rolls along the ground surface 12 about the axis of rotation 201. The rotation of the outer circumferential member 202 rotates the inner hub 204 including the interior surface 206. This rotation will rub the interior surface 206 against the cone-shaped surfaces 222, 232 of the first and second brake pads 220, 230, respectively. This rubbing will increase the rotational friction of the rotatable assembly 200. The extent of the rotational friction created by this drag will vary by the amount of force urging the cone-shaped surfaces 222, 232 against the interior surface 206 of the rotatable assembly 200. As in the embodiment shown in FIG. 6, this force may be varied by altering the compression means 250, 252, as is explained above.

This embodiment of the skate brake 170 may also use the deformation and reformation of the outer circumferential member 202 to dissipate energy and thereby help brake the skate. This takes place as described in the embodiment shown in FIG. 6.

Figure 10:
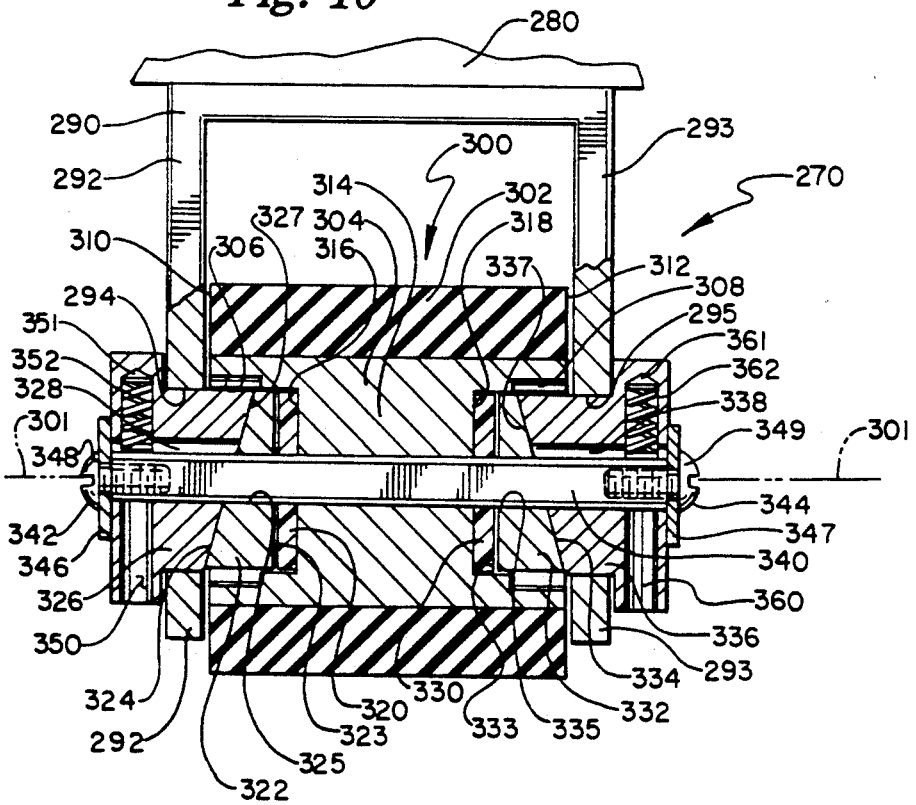
FIG. 10 is a view similar to that of FIG. 6 showing a still further alternative embodiment of the invention with the brake disengaged.
Figure 13:
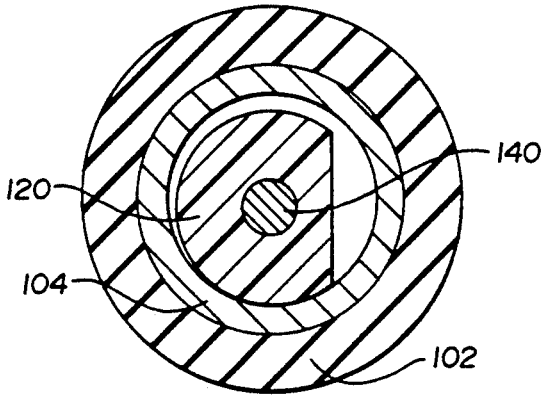
FIG. 13 is a section view of the invention shown in FIG. 6 taken along line 13 before there has been significant wearing of the invention.

Referring now to FIGS. 10, 11 and 12, a still further embodiment of the present invention can be seen. FIG. 10 shows the skate brake 270 in a nonbraking mode, while FIG. 12 shows the skate brake 270 as it appears during braking. In this embodiment, the skate brake 270 is mounted to a skate 280 through a bracket 290, the bracket 290 having a first wing 292 and a second wing 293, each having portions defining holes 294, 295, respectively. The hole 294 is preferably a D-shaped aperture with a flat side 296, while the hole 295 has an identical flat side which is not shown in the figures.

A rotatable assembly 300 designed to rotate about an axis of a rotation 301 is located between the wings 292 and 293. The rotatable assembly 300 has a first axial end 310, a second axial end 312, and an outer circumferential member 302, which has a generally circular cross section and is preferably bonded to an inner hub 304. As in the earlier embodiments, the outer circumferential member 302 is the only portion of the skate brake 270 which comes in contact with the ground surface 12 during braking and is preferably made of a moderately soft resilient material such as urethane rubber. The inner hub has an interior surface 306 which forms a recess 308.

An annular portion 314 extends radially inward from the interior surface 306 toward the axis of rotation 301 and is located intermediate the axial ends 310, 312 of the rotatable assembly 300. The annular portion has a first side 316 which faces toward the first axial end 310 and a second side 318 which faces toward the second axial end 312.

Passing through the center of the annular ring 314 along the axis of rotation 301 is an axle 340 having a flat surface 341, a first end 342 and a second end 344. On the first end 342 is a first terminating washer 346 and a first terminating screw 348. The first terminating screw 348 is threaded to the first end 342 of the axle 340, and serves to hold the first terminating washer 346 in place. On the second end 344 of the axle 340 is a second terminating washer 347 and a second terminating screw 349, the second terminating screw 349 being threaded to the second end 344 and holding the second terminating washer 347 in place.

Located on the axle 340 and adjacent the first side 316 of the annular portion 314 is a first brake media disk 320. Similarly, located on the axle 340 and adjacent to the second side 318 of the annular portion 314 is a second brake media disk 330. Each media disk 320, 330 is washer shaped and designed for inexpensive manufacture.

A first and second brake wedge 322, 332 are positioned on the axle 340 adjacent to the first and second brake media disks 320, 330, respectively. The first brake wedge 322 has an end surface 323, an angled cam surface 324 and an axle hole 325 which has a flat side 321. Likewise, the second brake wedge 332 has an end surface 333, an angled cam surface 334 and an axle hole 335 which has a flat side (not shown). The end surfaces 323, 333 are positioned adjacent to the brake media disks 320, 330, respectively, and are designed to urge the brake media disks 320, 330 against the annular portion 314 during braking operation.

Adjacent to the first brake wedge 322 on the axle 340 is a first compressing member 326 which has an angled compressing side 327 and a portion forming an axle slot 328 with a flat side 331. The axle slot 328, unlike the axle hole 325 of the first brake wedge 322, is designed to allow the axle 340 to move a short distance perpendicular to the axis of rotation 301. More specifically, the axle slot 328 allows the axle 340 to move closer to and further from the ground surface 12 with respect to the first compressing member 326. The first compressing member 326 is prevented from moving axially outward away from the first brake wedge 322 by the first terminating washer 346. The angled compressing side 327 is positioned adjacent to and in contact with the angled cam surface 324 of the first brake wedge 322, and preferably has an angle designed to be the supplement of the angle of the angled cam surface 324 as shown in FIG. 10.

The first compressing member 326 also contains a spring cavity 350 which extends through the axle slot 328 perpendicular to the axis of rotation 301. The spring cavity 350 does not extend through the entire first compressing member 326 but rather terminates at an end 351, thereby allowing a spring 352 to be positioned between the end 351 of the spring cavity 350 and the axle 340, with the axle 340 preventing the spring 352 from falling out of the spring cavity 350.

Adjacent to the second brake wedge 332 on the axle 340 is a second compressing member 336 of the same design as the first compressing member 326, including an angled compressing side 337, a portion forcing an axle slot 338 having a flat side (not shown), a spring cavity 360 having an end 361 and a spring 362. As with the first compressing member 326, the angle of the angled compressing side 337 of the second compressing member 336 is designed to be the supplement of the angle of the angled cam surface 334. The second compressing member 336 is prevented from moving axially outward away from the second brake wedge 332 by the second terminating washer 347.

The first compressing member 326 is designed to pass through the hole 294 in wing 292 of bracket 290. The first compressing member 326 has a flat surface 329 which engages the flat side 296 of the hole 294, preventing the first compressing member 326 from rotating with respect to the bracket 290. Similarly, the second compressing member 336 has a flat side (not shown) which engages with the flat side (not shown) of the hole 295 in the second wing 293 of the bracket 290, thereby preventing the second compressing member 336 from rotating with respect to the bracket 290.

The axle 340 is prevented from rotating with respect to the bracket 290 as a result of the interaction between the axle 340 and the compressing members 326, 336. The flat surface 341 of the axle 340 is positioned so as to engage the flat side 331 of the first compressing member 326 and the flat side (not shown) of the second compressing member 336. Thus the axle is prevented from rotating with respect to the compressing members 326, 336, which will not rotate with respect to the bracket 290 as explained above. Finally, the brake wedges 322, 332 are prevented from rotating by their interaction with the flat surface 341 of the axle 340. Specifically, the flat side 321 of the axle hole 325 of the first brake wedge 322 is designed to abut the flat surface 341 of the axle 340, while the flat side (not shown) of the axle hole 335 of the second brake wedge 332 similarly abuts the flat surface 341.

Referring now most particularly to FIG. 12, the embodiment of FIG. 10 of the present invention is shown during the braking process. A downward force 285 exerted by a skater (not shown) brings the skate brake 270 into contact with the ground surface 12. The motion of the skate 280 relative to the ground surface 12 causes the outer circumferential member 302 of the rotatable assembly 300 to begin rolling along the ground surface 12 about the axis of rotation 301. The downward force 285 also brings about an equal upward force caused by the ground surface 12 against the rotatable assembly 300. This upward force on the rotatable assembly 300 pushes the rotatable assembly 300 upward, which in turn pushes the axle 340, the brake media disks 320, 330 and the brake wedges 322, 332 upward. This upward push moves the axle 340 within in the axle slots 328, 338 and against the springs 352, 362 of the compressing members 326, 336, respectively. The compressing members 326, 336 are themselves prevented from moving upwards from their direct connection with the wings 292, 293 of the bracket 290. As a result, the outer circumferential member 302, the inner hub 304, the annular portion 314, the axle 300, the brake media disks 320, 330 and the brake wedges 322, 332 are shifted upwards relative to the skate 280, the bracket 290 and the compressing members 326, 336.

Because of the angled contact between the angled cam surface 324 of the first brake wedge 322 and the angled compressing side 327 of the first compressing member 326, the upward movement of the first brake wedge 322 relative to the first compressing member 326 urges the first brake wedge 322 axially inward toward the first brake media disk 320. This axially inward force on the brake media disk 320 urges the brake media disk 320 against the first side 316 of the annular portion 314.

Similarly, the upward movement of the angled cam surface 334 of the second brake wedge 332 relative to the angled compressing side 337 of the second compressing member 336 urges the second brake wedge 332 against the second brake media disk 330, thereby urging the second brake media disk 330 against the second side 318 of the annular portion 314.

The compression of the brake media disks 320, 330 against the annular portion 314 increases the rotational friction of the rotating member 300, and thereby increases the braking power of the brake 270. The further the axle 340 is pushed against the springs 352, 362, the harder the brake media disks 320, 330 rub against the annular portion and the greater the braking of the brake 270. When the downward force 285 is lessened, the springs 352, 362 urge the axle 340 downward in the axle slots 328, 338, thereby decreasing the force against the brake media disks 320, 330 and, consequently, decreasing the braking of the brake 270.

It is possible to construct the skate brake 270 without the use of the brake media disks 320, 330 by simply removing them and allowing the end surfaces 323, 333 of the brake wedges 322, 332 to abut the sides 316, 318 of the annular portion 314 directly. In fact, such a construction is to be understood to be within the scope of the present invention. The addition of the brake media disks 320, 330, however, allows for the easy and inexpensive replacement of a high-wear part. Since the brake media disks 320, 330 rotate against the annular portion 314 rather than the brake wedges 322, 332, the brake wedges 322, 332 will wear less and need fewer replacements than the cheaper and easier to manufacture brake media disks 320, 330.

The invention is not to be taken as limited to all of the details thereof as modifications, variations and improvements may be made while remaining within the spirit and scope of the invention as claimed.

What is claimed is:

1. In a skate of the type having a brake and a plurality of wheels for rolling on a ground surface, the wheels having a circumferential hardness and an average rotational friction, an improved skate brake comprising:

a) a bracket adapted to be mounted on one end of the skate;

b) a rotatable assembly mounted for rotation in the bracket and positioned on the skate such that the rotatable assembly is above the ground surface when no braking is desired, the rotatable assembly having i) an outer circumferential member having a circular cross-section and a rotatable assembly circumferential hardness, ii) an axis of rotation perpendicular to the circular cross-section of the outer circumferential member, iii) a first axial end and a second axial end, iv) an inner hub fixedly attached to the outer circumferential member, the inner hub having an interior surface and an inner hub hardness harder than the rotatable assembly circumferential hardness, and v) a rotational friction greater than the average rotational friction of the skate wheels;

c) a first brake pad located in physical contact with the interior surface of the inner hub; and d) a first securing means for securing the first brake pad against rotation when the inner hub rotates; such that the skate is pivotable about at least one wheel to bring the rotatable assembly into contact with the ground surface so as to cause the rotatable assembly to rotate about the axis of rotation and provide braking as a result of the rotational friction of the rotatable assembly.

2. The skate brake of claim 1, wherein the inner hub interior surface defines a recess and the first brake is located within the recess.

3. The skate brake of claim 2, further comprising:

e) an annular portion having a first side and a second side, the annular portion located in the recess intermediate the first axial end and the second axial end of the rotatable assembly and extending from the interior surface of the inner hub toward the axis of rotation;

f) an end surface of the first brake pad located adjacent to and in physical contact with the first side of the annular portion;

g) a second brake pad having an end surface located within the recess adjacent to and in physical contact with the second side of the annular portion;

h) a compression means for compressing the end surfaces of the first and second brake pads against the first and second sides of the annular portion, respectively; and i) a second securing means for securing the second brake pad against rotation; such that the rotation of the rotatable assembly when in contact with the ground surface rotates the annular portion against the end surfaces of the first and second brake pads, increasing the rotational friction of the rotatable assembly.

4. The skate brake of claim 3, wherein the first and second brake pads each have portions defining a hole, the skate brake further comprising:

j) an axle projecting through the holes in the first and second brake pads, the axle having a first and second end, each of the first and second ends of the axle having a terminating member.

5. The skate brake of claim 4, wherein the axle comprises a partially threaded bolt, the terminating member of the first end of the axle comprises a locking nut, and the terminating member of the second end of the axle comprises a button head on the bolt.

6. The skate brake of claim 4, wherein the compression means comprises a first spring compressed between the terminating member of the first end of the axle and the first brake pad, and a second spring compressed between the terminating member of the second end of the axle and the second brake pad.

7. The skate brake of claim 3, wherein:

the first brake pad further comprises a lateral surface located adjacent to and in physical contact with the interior surface of the inner hub; and the second brake pad further comprises a lateral surface located adjacent to and in physical contact with the interior surface of the inner hub;

such that the force of the ground surface in contact with the rotatable assembly compels the interior surface to rotate against the lateral surfaces of the first and second brake pads, increasing the rotational friction of the rotatable assembly.

8. The skate brake of claim 7, wherein:

the interior surface of the inner hub comprises a cylindrical portion having a diameter; and the lateral surfaces of the first and second brake pads comprise partial cylinders having diameters smaller than the diameter of the adjacent cylindrical portion of the interior surface.

9. The skate brake of claim 2, wherein the first brake pad has a lateral surface located adjacent to and in physical contact with the interior surface of the inner hub;

such that the force of the ground surface in contact with the rotatable assembly compels the interior surface to rotate against the lateral surface of the first brake pad, increasing the rotational friction of the rotatable assembly.

10. The skate brake of claim 7, wherein the interior surface of the inner hub comprises a cylindrical portion having a diameter; and the lateral surface of the first brake pad comprises a partial cylinder having a diameter smaller than the diameter of the respective adjacent cylindrical portion of the interior surface;

such that, after a period of use, the lateral surface of the first brake pad wears into a shape more closely resembling the interior surface of the inner hub, thus increasing the area of interaction and increasing the braking of the skate brake.

11. The skate brake of claim 2, further comprising:

c) an annular portion having a first side and a second side, the annular portion located in the recess intermediate the first axial end and the second axial end of the rotatable assembly and extending from the interior surface of the inner hub toward the axis of rotation;

d) an axle with a first and second end, extending through the recess of the inner hub;

e) a first brake wedge, having an angled cam surface, an end surface, and a portion forming an axle hole passing from the angled cam surface to the end surface, the first brake wedge being located on the axle with the end surface adjacent the first side of the annular portion;

f) a second brake wedge, having an angled cam surface, an end surface, and a portion forming an axle hole passing from the angled cam surface to the end surface, the second brake wedge being located on the axle with the end surface adjacent to the second side of the annular portion;

g) a first compressing member having an angled compressing side, a spring cavity, a spring and a portion forming an axle slot, the first compressing member being located on the axle with the angled compressing side adjacent to the angled cam surface of the first brake wedge, the spring being located in the spring cavity and in contact with the axle;

h) a second compressing member having an angled compressing side, a spring cavity, a spring and a portion forming an axle slot, the second compressing member being located on the axle with the angled compressing side adjacent to the angled cam surface of the second brake wedge, the spring being located in the spring cavity and in contact with the axle;

i) a first and second terminating member secured to the first and second end of the axle, respectively, preventing the compressing members from moving axially outward along the axle; and j) a securing means for securing the brake pads against rotation;

such that the force of the ground surface in contact with the rotatable assembly urges the interior surface of the rotatable assembly upwards, which in turn urges the axle and the brake wedges upward, such that the axle moves upward within the axle slot and against the springs of the first and second compressing members, such that the angled cam surfaces of the brake wedges interact with the angled compressing sides of the compressing members, translating the upward movement of the brake wedges into a sideways compressing force, thereby urging the brake wedges axially inward against the sides of the annular portion increasing the rotational friction of the rotatable assembly.

12. The skate brake of claim 11, further comprising k) a first brake media disk located on the axle between the end surface of the first brake wedge and the first side of the annular portion; and 1) a second brake media disk located on the axle between the end surface of the second brake wedge and the second side of the annular portion;

such that the end surfaces of the brake wedges urge the brake media disks into the sides of the annular portion, thereby allowing the majority of wear to occur in the brake media disks rather than the brake wedges.

13. The skate brake of claim 2, wherein the recess defined by the interior surface has a generally hourglass shaped cross-section forming a first tapered recess and a second tapered recess.

14. The skate brake of claim 13, further comprising:

c) a first brake pad having a generally cone-shaped surface located in the first tapered recess, with the cone-shaped surface adjacent to and in contact with the interior surface;

d) a second brake pad having a generally cone-shaped surface located in the second tapered recess, with the cone-shaped surface adjacent to and in contact with the interior surface;

e) a compressing means for compressing the cone-shaped surfaces of the first and second brake pads against the portion interior surface forming the first and second tapered recess, respectively; and f) a securing means for securing the brake pads against rotation;

such that the interior surface of the rotatable assembly rotates against the cone-shaped surfaces of the brake pads, increasing the rotational friction of the rotatable assembly.

15. The skate brake of claim 1, wherein the outer circumferential member comprises a resilient material, and the rotatable assembly circumferential hardness is less than the circumferential hardness of the skate wheels, such that the outer circumferential member of the rotatable assembly deforms as a result of the contact with the ground surface so as to dissipate energy and further cause the skate to brake.

16. The skate brake of claim 15, wherein the outer circumferential member comprises urethane rubber.

17. The skate brake of claim 1, wherein the first securing means comprises a flat surface on the first brake pad; and portion of the bracket defining a flat-sided hole;

wherein the first brake pad extends through the hole of the bracket with the flat surface of the first brake pad contacting the flat side of the hole through which it extends, such that the first brake pad is prevented from rotating with respect to the bracket.

18. A skate for rolling on a ground surface comprising:

a) a foot support member for supporting a foot of a user, the foot support member having a bottom surface;

b) a plurality of wheels having an average rotational friction and a circumferential hardness, the wheels being attached to the bottom surface of the foot support member and positioned to roll along the ground surface;

c) a bracket adapted to be mounted on one end of the skate; and d) a rotatable assembly mounted for rotation in the bracket and positioned on the skate such that the rotatable assembly is above the ground surface when no braking is desired, the rotatable assembly having i) an outer circumferential member having a circular cross-section and a rotatable assembly circumferential hardness, ii) an axis of rotation perpendicular to the circular cross-section of the outer circumferential member, iii) a first axial end and a second axial end, iv) an inner hub bonded to the outer circumferential member, the inner hub having an interior surface which defines a recess inside the rotatable assembly and also having an inner hub hardness harder than the rotatable assembly circumferential hardness, and v) a rotational friction, the rotational friction of the rotatable assembly being greater than the average rotational friction of the skate wheels;

e) a first brake pad located within the recess being in physical contact with the inner hub; and f) a first securing means for securing the first brake pad against rotation when the inner hub rotates;

such that the skate is pivotable about at least one wheel to bring the rotatable assembly into contact with the ground surface so as to cause the rotatable assembly to rotate about the axis of rotation and provide braking as a result of the rotational friction of the rotatable assembly.

19. The skate of claim 18, wherein the outer circumferential member of the rotatable assembly comprises a resilient material, and the rotatable assembly circumferential hardness is less than the circumferential hardness of the skate wheels, such that the outer circumferential member of the rotatable assembly deforms as a result of the contact with the ground surface, thereby dissipating energy and further causing the skate to brake.

20. The skate of claim 18, further comprising:

g) an annular portion having a first side and a second side, the annular portion located in the recess intermediate the first axial end and the second axial end of the rotatable assembly and extending from the interior surface of the inner hub toward the axis of rotation;

h) an end surface of the first brake pad being located within the recess adjacent to the first side of the annular portion;

i) a second brake pad having an end surface located within the recess adjacent the second side of the annular portion;

j) an urging means for urging the end surfaces of the first and second brake pads against the first and second sides of the annular portion, respectively; and k) a second securing means for securing the second brake pad against rotation;

such that the rotation of the rotatable assembly when in contact with the ground surface rotates the annular portion against the end surfaces of the first and second brake pads, increasing the rotational friction of the rotatable assembly.

21. The skate of claim 20, further comprising:

l) an axle with a first and second end, the first and second ends of the axle each having a terminating member;

m) wherein the first and second brake pad each have portions defining a hole through which the axle extends.

22. The skate of claim 21, wherein the urging means comprise a first spring compressed between the terminating member of the first end of the axle and the first brake pad, and a second spring compressed between the terminating member of the second end of the axle and the second brake pad.

23. The skate of claim 20, wherein:

the first brake pad further comprises a lateral surface located within the recess adjacent the interior surface of the inner hub; and the second brake pad further comprises a lateral surface located within the recess adjacent the interior surface of the inner hub;

such that the force of the ground surface in contact with the rotatable assembly compels the interior surface to rotate against the lateral surfaces of the first and second brake pads, increasing the rotational friction of the rotatable assembly.

24. The skate of claim 18, wherein the first brake pad has a lateral surface located within the recess adjacent to the interior surface of the inner hub and such that the force of the ground surface in contact with the rotatable assembly compels the interior surface to rotate against the lateral surface of the first brake pad, increasing the rotational friction of the rotatable assembly.

25. The skate of claim 18, wherein the recess defined by the interior surface has an hour-glass shaped cross-section forming a first tapered recess and a second tapered recess.

26. The skate of claim 25, further comprising:

g) the first brake pad having a cone-shaped surface located in the first tapered recess, wit the cone-shaped surface of the first brake pad adjacent to and in contact with the interior surface;

h) a second brake pad having a cone-shaped surface located in the second tapered recess, with the cone-shaped surface of the second brake pad adjacent to and in contact with the interior surface;

i) a compressing means for compressing the cone-shaped surfaces of the first and second brake pads against the interior surface of the first and second tapered recess, respectively; and j) a securing means for securing the brake pads against rotation;

such that the interior surface of the rotatable assembly rotates against the cone-shaped surfaces of the brake pads, increasing the rotational friction of the rotatable assembly.

27. A method for stopping a skate of the type supported by a plurality of wheels having an average rotational friction, comprising:

a) pivoting the skate about at least one wheel to bring a resilient outer circumferential member of a rotatable assembly attached to the skate in contact with a ground surface;

b) rotating the rotatable assembly along the ground surface; and c) applying friction to the rotation of the rotatable assembly to increase the rotational friction of the rotatable assembly to a point greater than the average rotational friction of the wheels by urging a non-rotating brake pad against a hard, non-resilient inner portion of the rotating rotatable assembly.

28. The method of claim 27, further comprising d) deforming the resilient outer circumferential member of the rotatable assembly as it rotates along the ground surface.

29. The method of claim 27, wherein the step c) further comprises compressing an end surface of the non-rotating brake pad against the side of an annular portion attached to and rotating with the non-resilient portion of the rotatable assembly.

30. The method of claim 29, wherein the step c) further comprises locating the non-rotating brake pad within a recess defined by an interior surface of the non-resilient portion of the rotatable assembly, and rotating an interior surface against a lateral surface of the non-rotating brake pad.

31. The method of claim 27, wherein the step c) further comprises locating the non-rotating brake pad within a recess defined by an interior surface of the non-resilient portion of the rotatable assembly, and rotating the interior surface against a lateral surface of the non-rotating brake pad.

* * * * *